US006168753B1

(12) United States Patent
Morando

(10) Patent No.: US 6,168,753 B1
(45) Date of Patent: Jan. 2, 2001

(54) INERT PUMP LEG ADAPTED FOR IMMERSION IN MOLTEN METAL

(75) Inventor: Jorge A. Morando, Cadiz, KY (US)

(73) Assignee: Alphatech, Inc., Cadiz, KY (US)

( * ) Notice: Under 35 U.S.C. 154(b), the term of this patent shall be extended for 0 days.

(21) Appl. No.: 09/174,624

(22) Filed: Oct. 19, 1998

Related U.S. Application Data

(63) Continuation-in-part of application No. 09/130,937, filed on Aug. 7, 1998, now Pat. No. 6,071,074.

(51) Int. Cl.[7] ..... C21C 7/00
(52) U.S. Cl. ..... 266/233; 266/286; 266/287
(58) Field of Search ..... 266/233, 235, 266/236, 239, 286, 287; 222/590, 591, 594; 417/360; 428/408

(56) References Cited

U.S. PATENT DOCUMENTS

| | | | | |
|---|---|---|---|---|
| 5,092,500 | * | 3/1992 | Weber et al. | 222/606 |
| 5,558,505 | * | 9/1996 | Mordue et al. | 417/360 |
| 5,716,195 | * | 2/1998 | Thut | 417/360 |

* cited by examiner

*Primary Examiner*—Scott Kastler
(74) *Attorney, Agent, or Firm*—Charles W. Chandler

(57) ABSTRACT

A graphite support leg for positioning an object, such as a pump, in a bath of molten metal. The leg is enclosed in a ceramic sleeve, and an inert material is disposed in a clearance between the leg and the sleeve to protect the leg from the heat of the molten metal.

16 Claims, 4 Drawing Sheets

INERT PUMP LEG ADAPTED FOR IMMERSION IN MOLTEN METAL

CROSS-REFERENCE TO RELATED APPLICATION

This application is a continuation-in-part of application Ser. No. 09/130,937, filed Aug. 7, 1998 for "Advanced Motor Driven Impeller Pump for Moving Metal in a Bath of Molten Metal", now U.S. Pat. No. 6,071,074.

BACKGROUND OF THE INVENTION

This invention is related to a structure for supporting a pump or similar apparatus immersed below the metal level of a bath of molten metal, such as aluminum or zinc.

In my aforementioned co-pending patent application, I disclosed a vertical post or leg for supporting a pump immersed in a bath of molten metal beneath an overhead structure above the bath of molten metal. Certain pumps disclosed in my prior patent application are buoyant in a bath of molten metal because of their lower specific density. In order to locate the pump in a suitable position below the metal level, it is desirable to have one or more overhead support legs. I disclosed a support leg having a ceramic sleeve extending between the overhead structure and the pump. The ceramic sleeve material is resistant to the heat of the molten metal. An internal vertical graphite leg is disposed in the sleeve. The graphite leg has sufficient compressive strength to support the pump in the bath of molten metal but has a tendency to burn in the presence of heat and oxygen. I disclosed a means for protecting the graphite leg by providing an internal chamber around the graphite leg and in the ceramic sleeve. An inert gas, such as nitrogen, protects the graphite from burning. However, I have found in some cases it is unnecessary to have a gas filled chamber in the sleeve to protect the graphite. Further, I have found novel means for introducing an inert gas into the ceramic sleeve to prevent burning of the graphite.

SUMMARY OF THE INVENTION

The broad purpose of the present invention is to provide an improved vertical leg structure for supporting a pump immersed in a bath of molten metal beneath an overhead structure disposed above the molten metal. In the preferred embodiment of the invention a ceramic sleeve extends between the overhead structure and the pump housing. It has a sufficient height to hold the housing in the bath of molten metal. An internal leg of a graphite material is disposed in the sleeve to provide a vertical support between the overhead structure and the pump housing.

A slight clearance between the ceramic sleeve and the graphite leg forms a chamber which is filled in various ways by both, gaseous and non-gaseous but inert materials. The leg comprises a vertical ceramic sleeve housing and a vertical graphite leg that extends between the overhead supporting structure and the pump housing. The sleeve covers that portion of the graphite exposed to the heat of the molten metal and above the metal line where severe burning of the graphite would occur due to the oxygen present in air.

Still further objects and advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views and in which.

DESCRIPTION OF THE PREFERRED EMBODIMENT

Figure 1:
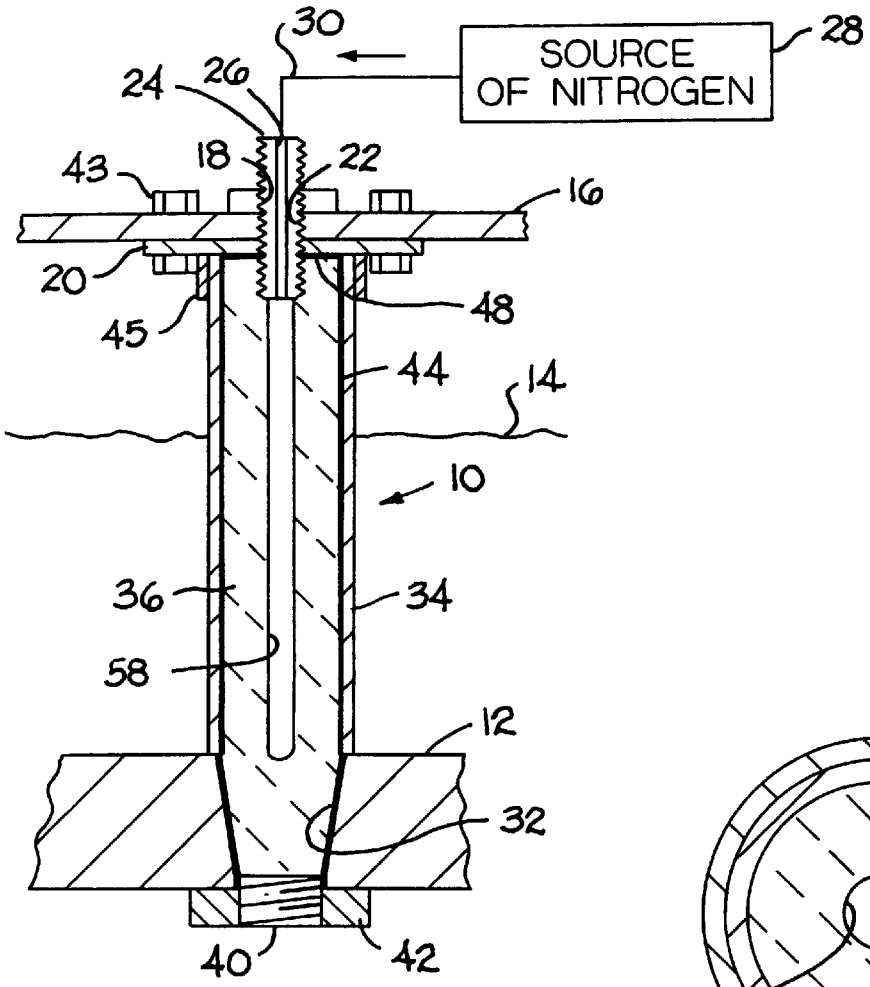
FIG. 1 shows a ceramic sleeve shielding a leg disposed in an atmosphere containing an inert gas.

FIG. 1 shows a shielded leg 10 supporting a pump housing 12 beneath the metal level 14 of a bath of molten metal, such as aluminum or zinc. The upper end of the leg is connected to a cover plate 16.

The cover plate has an opening 18. An annular plate 20 is mounted on the underside of the cover plate and has a central opening 22 aligned with opening 18. A fitting 24 has a gas-receiving passage 26 for receiving an inert gas, such as nitrogen, from a source of nitrogen 28 through conduit means 30.

The pump housing has a frusto-conical opening 32 which extends between its upper and lower surfaces. A sleeve formed of a ceramic material that is resistant to the heat of the molten metal is mounted between mounting plate 20 and the top surface of the pump housing around opening 32. Sleeve 34 has a cylindrical configuration and has its upper and lower ends seated against mounting plate 20 and the pump housing, respectively.

A graphite leg 36, having a sufficient diameter to provide a structured support between cover plate 16 and pump housing 12, has its upper end abutting the mounting plate and its lower end formed with a reduced frusto-conical exterior surface that is seated in opening 32. The lower end 40 of the graphite leg is threaded for receiving a fastening nut 42.

Mounting plate 20 is attached by fastener means 43 to the cover plate.

A cement, modified by adding boron nitrite or boronit paint (obtainable from Alphatech, Inc., Cadiz, Ky.) is coated between the outer surface of the graphite leg, in the areas of the thicker line 44, and the ceramic sleeve, as well as between the lower end of the leg seated in opening 32, and the upper end of the leg in contact with the cylindrical skirt 45 of the mounting plate to provide a seal between the ceramic sleeve and the graphite leg that prevents the penetration of the molten metal.

A Kawool gasket 48 is mounted between the upper end of the leg and the mounting plate.

The graphite leg material has sufficient porosity to impregnate with the inert gas and create a chamber of inert nitrogen gas that prevents a combustible gas from permeating inside the ceramic sleeve to burn the graphite leg.

Figure 2:
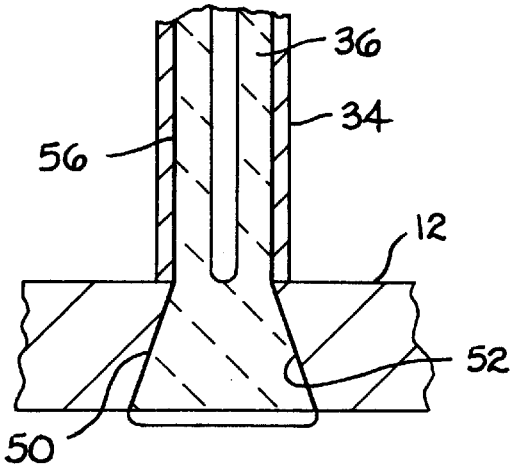
FIG. 2 is a view of an alternative means for connecting the lower end of the leg to the pump housing.

Referring to FIG. 2, an alternative means for connecting leg 36 to pump housing 12 is illustrated in which the lower end of the leg has been enlarged to provide a frusto-conical outer surface at 50 that mates with a frusto-conical interior opening 52 in housing 12 to provide a simple disassemble and removal of a damaged leg eventuity.

The diameter of the leg is slightly smaller than the inner surface of the sleeve and of opening 52. A suitable inert cement 56 occupies the space between the ceramic shield and the leg.

Referring back to FIG. 1, the graphite leg has an axial passage 58 connecting passage 24 so that the inert gas (nitrogen) can pass along the major length of the leg. The graphite is sufficiently porous to house the inert gas and prevent the entry of either air or molten metal inside the sleeve—leg chamber.

Figure 3:
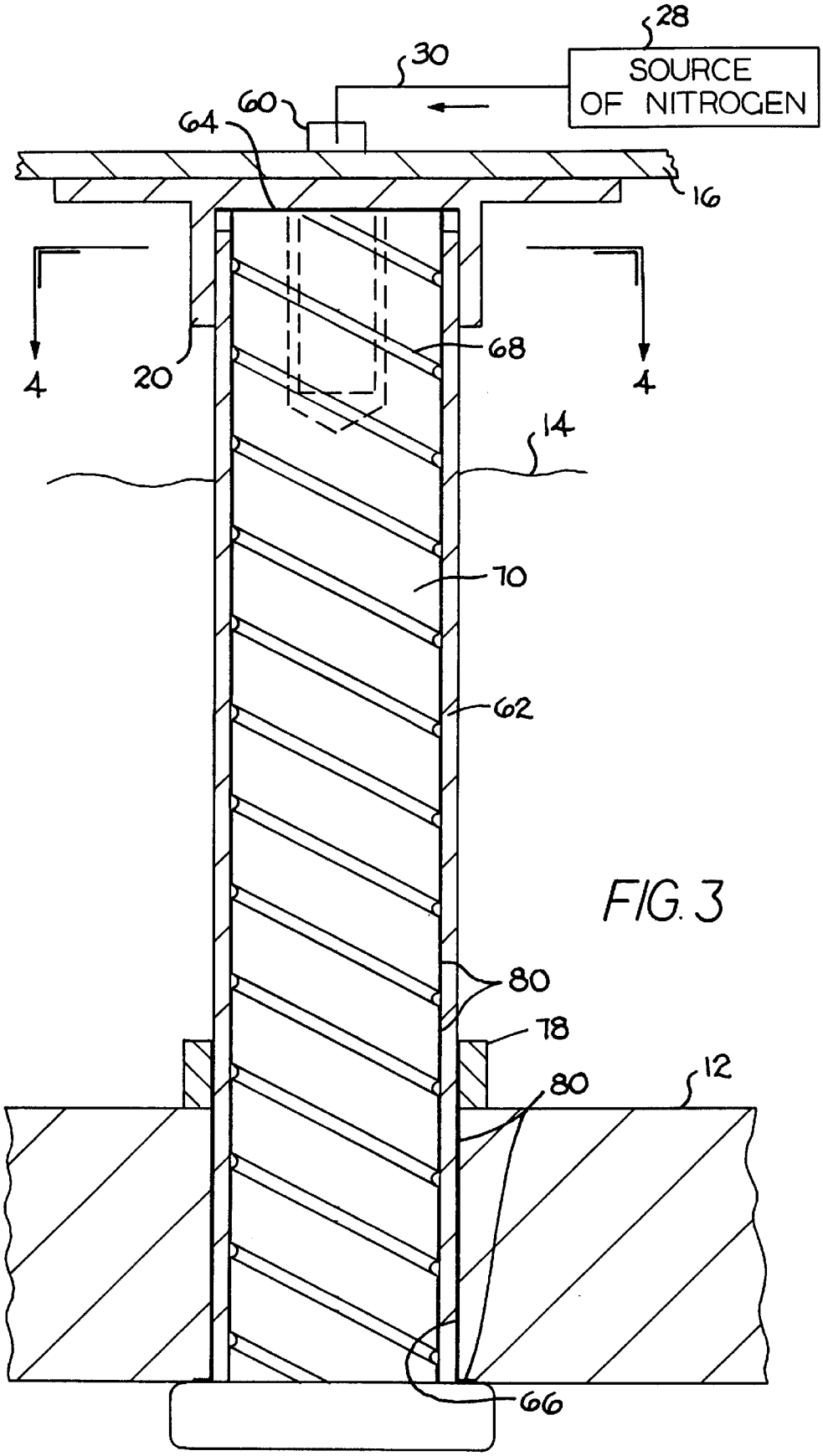
FIG. 3 is a view of another support leg in which the graphite is shielded by a inert gas.

FIG. 3 illustrates another embodiment of the invention. In this case, cover plate 16 provides an overhead supporting structure above metal level 14. Pump housing 12 is immersed in the bath of molten metal. Mounting plate 20 is disposed on the under side of the cover plate and connected by fitting 60 to a source of nitrogen under pressure 28 through conduit 30. Ceramic sleeve 62 has its upper end in abutment with a Kawool gasket 64 on the underside of the mounting plate to create a sealed chamber between the ceramic sleeve and graphite leg.

The sleeve extends through a cylindrical opening 66 in the pump housing and is cemented by a suitable inert cement to the pump housing in the area indicated by heavy line 80. Graphite leg 70 is housed inside the sleeve and has at its lower end an enlargement to engage and support the pump housing. The outer diameter generally corresponds to the inner diameter of the sleeve but allowing for any desirable (not necessary) refractory cement 80 to join the leg to the sleeve and for thermal expansion. The upper end of the sleeve also abuts gasket 64. The lower end of the sleeve extends to the inner surface of the pump housing.

Figure 4:
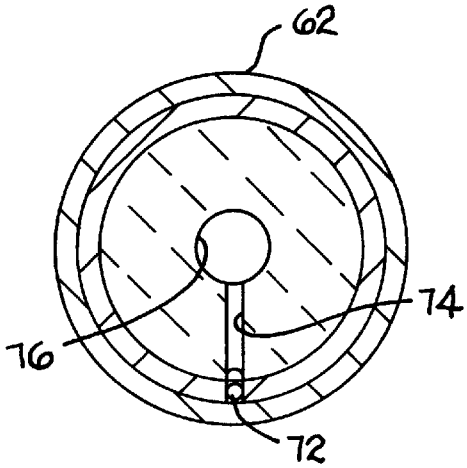
FIG. 4 is a view as seen along lines 4—4 of FIG. 3.

The graphite leg is formed with an external helical groove 68 which extends from its upper end to its lower end. Referring to FIG. 4, the groove has an upper end 72 in communication with a radial channel 74 in the leg. The inner end of channel 74 terminates with a vertical passage 76 which is connected to conduit 30. Thus the nitrogen gas forms a helical shield around the vertical leg extending from its upper end to its lower end. A ceramic ring 78 is cemented to the sleeve to aid in preventing pump housing 12 from any vertical movement.

FIGS. 5–8 show still another embodiment of the invention in which a ceramic sleeve 100 has its lower end in abutment and sealed with the pump housing. The upper end of the sleeve extends above metal level 14 to a position adjacent mounting plate 20.

A graphite leg 102 has its upper end in abutment with mounting plate 20 and its lower end seated in an opening 104 in the pump housing. The lower end of the leg has an annular groove 106. The housing opening 104 has an annular groove 108. The lower end of the leg is slightly smaller than the housing opening. Grooves 106 and 108 and the space between the lower end of the leg and the housing opening are filled with a cement in the area of the heavier line 110 to prevent any molten metal from entering the lower end of the ceramic sleeve, and to join the leg to the housing.

Figure 5:
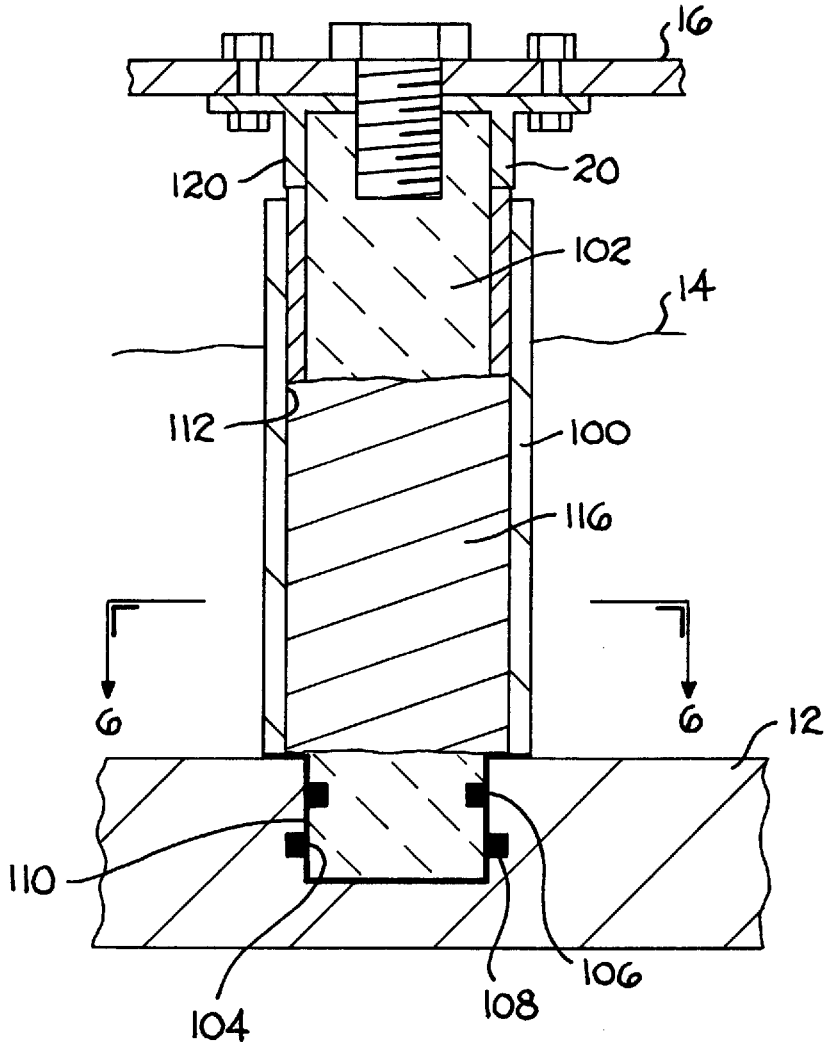
FIG. 5 is a view in which the sleeve provides an inert chamber containing inert non-gaseous materials for protecting the graphite leg.
Figure 6:
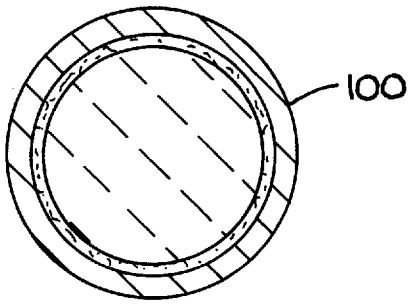
FIG. 6 is a view as seen along lines 6—6.
Figure 7:
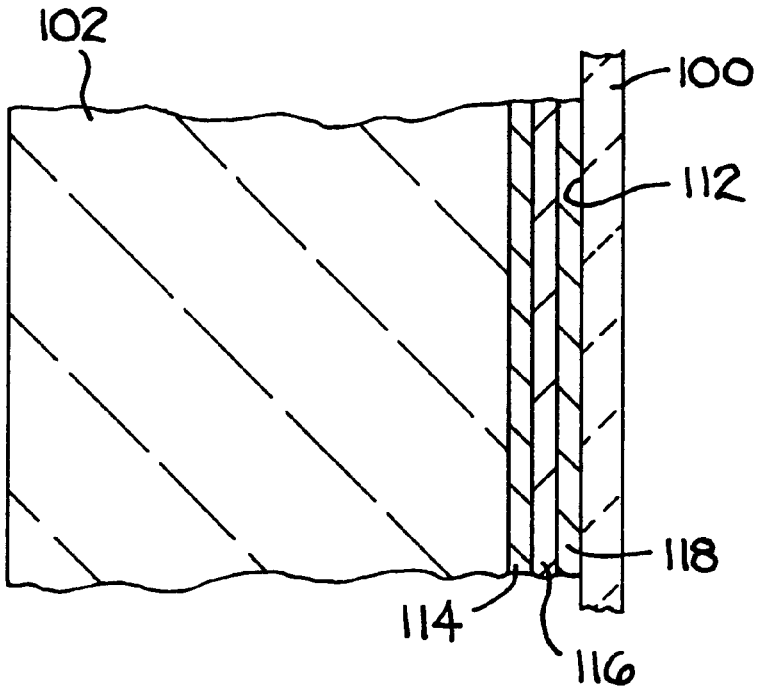
FIG. 7 is an enlarged fragmentary view of the inert chamber.

The leg has an outer diameter smaller than the inside diameter of the sleeve to provide a tubular chamber 112. Preferably the chamber has a thickness, as illustrated in FIG. 7, filled with respectively, a mix of boron nitride paint and a suitable refractory cement coating 114, a nylon tape 116 and outer layer 118, also a mix of cement and boron nitride paint. The nylon tape is cemented by a combination of the refractory cement and boron nitride paint which constitutes inner and outer layers 114 and 118. The nylon tape is wrapped in a helical wrapping as illustrated in FIG. 5 from the bottom of the cylindrical skirt 120 of the mounting plate 20 to the pump housing. When the cement mix has dried, an additional layer is applied over and around the helical tape to form layer 118. Prior to the cement mix drying, this arrangement is then disposed inside the sleeve to form a gas-free environment between the leg and the sleeve now filled with inert materials that shield the graphite leg from burning gases.

Figure 8:
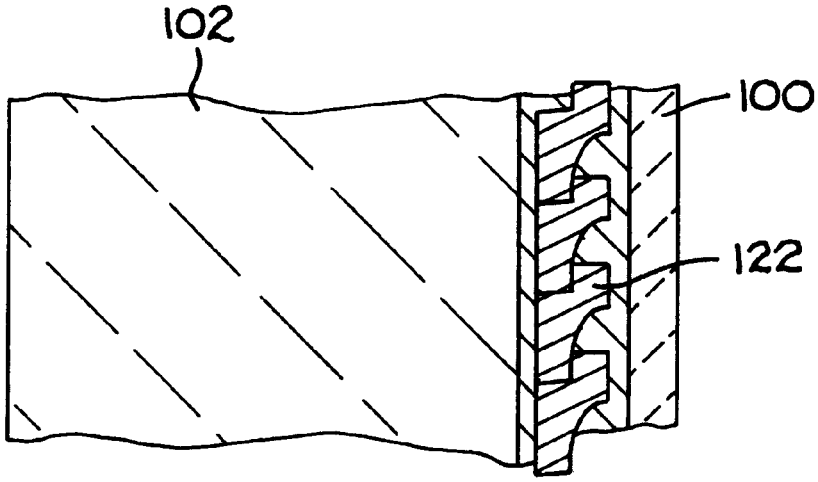
FIG. 8 is still a further enlarged view showing the manner in which a nylon tape is wrapped around the leg to form a double chamber containing a porous cement.

FIG. 8 is an enlarged view of the manner in which the tape is wrapped. It is preferably wrapped in an overlapping arrangement as illustrated at 122. Thus the nylon tape provides double cylindrical chambers of a ceramic low porosity cement which is both inert and non-wetting in aluminum. The boron nitride reduces the porosity of the cement and simultaneously increases the surface tension thereby eliminating the ability of molten aluminum or molten zinc to penetrate between the ceramic sleeve and the graphite leg.

Having described my invention, I claim:

1. A support structure having a lower end suited for positioning an object such as a pump housing below the surface of a bath of molten metal, and an upper end suited for connection to structure above the bath of molten metal, comprising:

an elongated support leg of a graphite material, a sleeve housing said support leg, said sleeve being formed of a ceramic that is resistant to the heat of the molten metal, both the leg and the sleeve having a length suited for connection to a support structure above the bath of molten metal and a lower end suited for connection to a structure immersed below the metal level of the bath of molten metal;

means forming a helical groove between the interface of the graphite leg and the ceramic sleeve extending from the upper end of the leg to a location proximate said immersed structure; and a source of an inert gas, and means for connecting said source of inert gas to said helical groove to fill the groove.

2. A support structure as described in claim 1, where the groove is axially located on the interface of the leg and the ceramic sleeve to generate an inert gas protective chamber.

3. A support suited for positioning a pump or other similar device disposed in a bath of molten metal, beneath an overhead support structure disposed above the metal level of the bath, comprising:

a graphite leg having an upper end and a lower end, the leg having a sufficient compressive strength to prevent an object from rising in molten metal, the leg having a tendency to be combustible in the presence of oxygen, and non-combustible in the presence of an inert material;

first means for connecting the graphite leg to an overhead support structure, and second means for connecting the graphite leg to an object disposed in a bath of molten metal;

structure enclosing that portion of the graphite leg disposed in the bath of molten metal, including a ceramic sleeve telescopically enclosing the leg, the ceramic sleeve being resistant to the heat of molten metal;

third means forming a clearance between the graphite leg and the ceramic sleeve; and an inert non-gaseous material disposed in said clearance to form a non-combustible barrier between the graphite leg and the molten metal.

4. A support as defined in claim 3, in which the inert material includes a nylon tape, and a coating of refractory cement mixed with boron nitride paint to form a gas-free environment between the graphite leg and the ceramic sleeve.

5. A support as defined in claim 4, in which the nylon tape is wrapped in a helical wrapping around the graphite leg.

6. A support as defined in claim 3, in which the lower end of the leg is capable of being connected to a pump housing.

7. A support suited for positioning a pump or similar device disposed in a bath of molten metal, beneath an overhead support structure disposed above the metal level of the bath; comprising:

a leg of a material capable of being penetrated by a gas, having an upper end and a lower end, the leg having a sufficient compressive strength to prevent an object from rising in molten metal, the leg having a tendency to be combustible in the presence of oxygen, and non-combustible in the presence of an inert gas;

first means for connecting the leg to an overhead support structure; and second means for connecting the leg to an object disposed in a bath of molten metal;

structure enclosing that portion of the leg disposed in the molten metal to form a sealed chamber, including a ceramic sleeve telescopically enclosing the leg, the ceramic sleeve being resistant to the heat of molten metal; and a source of an inert gas, and means for introducing the gas into the sleeve to so penetrate the leg as to prevent it from burning when disposed in molten metal.

8. A support as defined in claim 7, in which the leg is formed of a graphite material.

9. A support as defined in claim 7, in which the gas is nitrogen.

10. A support as defined in claim 7, in which the lower end of the leg is connected to a pump housing.

11. A support as defined in claim 7, in which the leg has an axial passage, and including a source of an inert gas connected to said axial passage to impregnate the leg with the inert gas.

12. A support suited for positioning a pump or other similar device disposed in a bath of molten metal, beneath an overhead support structure disposed above the metal level of the bath, comprising:

a graphite leg having an upper end and a lower end, the graphite having a sufficient compressive strength to prevent an object from rising in molten metal, the leg having a tendency to be combustible in the presence of oxygen, and non-combustible in the presence of an inert material, at first means for connecting the graphite leg to an overhead support structure, and second means for connecting the graphite leg to an object disposed in a bath of molten metal; and structure enclosing that portion of the graphite leg disposed in a bath of molten metal to form a barrier between the graphite leg and the molten metal including a ceramic sleeve having a lower end telescopically enclosing the leg, the ceramic sleeve being resistant to the heat of molten metal.

13. A support as defined in claim 12, including structure in the opening in the pump housing for joining the leg to the pump housing and for preventing molten metal from entering the lower end of the ceramic sleeve.

14. A support suited for positioning a pump having a housing disposed in a bath of molten metal, beneath an overhead support structure disposed above the metal level of the bath, comprising:

a pump housing having an opening;

a graphite leg having an upper end and a lower end, the graphite leg having a sufficient compressive strength to prevent the pump housing from rising in molten metal, the graphite leg having a tendency to be combustible in the presence of oxygen, and non-combustible in the presence of an inert material at such times as the graphite leg is disposed in a bath of molten metal;

first means for connecting the graphite leg to an overhead support structure, and second means for connecting the graphite leg in the opening in the pump housing; and structure forming a barrier between the graphite leg and the molten metal including a ceramic sleeve telescopically enclosing the leg, the ceramic sleeve being resistant to the heat of molten metal.

15. A support as defined in claim 14, in which the lower end of the graphite leg extends through the opening in the pump housing, and including a fastener threadably connected to the leg to join the leg to the pump housing.

16. A support as defined in claim 14, in which the pump-housing opening has a frusto-conical configuration, and the graphite leg has a frusto-conical end mated with the opening in the pump housing.

* * * * *